US006659994B1

(12) United States Patent
Mader et al.

(10) Patent No.: US 6,659,994 B1
(45) Date of Patent: Dec. 9, 2003

(54) BAG FOR STORING A FIRST SUBSTANCE INJECTABLE, IN PARTICULAR, IN A HUMAN OR ANIMAL BODY

(75) Inventors: Helmut Mader, Hilpoltstein (DE); Michael Krause, Nürnberg (DE); Horst Schwietz, Allersberg (DE); Franz Fritzmeier, Gunzenhausen (DE); Karlheinz Baumann, Roth (DE)

(73) Assignee: Nutrichem Diät + Pharma GmbH, Roth (DE)

( * ) Notice: Subject to any disclaimer, the term of this patent is extended or adjusted under 35 U.S.C. 154(b) by 0 days.

(21) Appl. No.: 09/452,300

(22) Filed: Dec. 1, 1999

(51) Int. Cl.[7] ..... A61B 19/00; B65D 17/42; B65D 33/00

(52) U.S. Cl. ..... 604/408; 604/410; 604/411; 604/416; 604/903; 220/277; 383/202

(58) Field of Search ..... 604/408, 410, 604/411, 414, 416, 403, 412, 903; 206/222; 128/DIG. 24; 220/500–501, 506, 265–268, 62.21, 277; 383/200, 202, 38, 127, 906; 222/129, 81, 222, 541.1–541.2

(56) References Cited

U.S. PATENT DOCUMENTS 4,515,586 A * 5/1985 Mendenhall et al. ..... 604/416
4,548,606 A * 10/1985 Larkin ..... 206/222
4,601,704 A * 7/1986 Larkin ..... 604/416
4,609,369 A * 9/1986 Ball ..... 206/219
5,114,004 A * 5/1992 Isono et al. ..... 206/222

FOREIGN PATENT DOCUMENTS

| | | |
|---|---|---|
| DE | 9600530 | 7/1997 |
| DE | 9751489 | 5/1999 |
| EP | 0919216 A1 * | 11/1998 |
| EP | 0993819 A2 * | 10/1999 |
| WO | 9103224 | 3/1991 |

OTHER PUBLICATIONS

Search Report.

* cited by examiner

*Primary Examiner*—Angela D. Sykes
*Assistant Examiner*—Patricia Bianco
(74) *Attorney, Agent, or Firm*—Sidley Austin Brown & Wood, LLP

(57) ABSTRACT

A bag arrangement for intermixing two, separately stored substances. The bag arrangement includes a bag having a jacket defining an inner chamber for accommodating a first substance and a piercing device having a chamber in which the jacket is received. A single piercing member is provided on one side of the jacket and a hollow abutment is located opposite the piercing member on an opposite side of the jacket and forms a receptacle for accommodating a second substance. Upon actuation of the piercing device, the piercing member pierces the opposite sides of the jacket providing for intermixing of the first and second substances.

2 Claims, 6 Drawing Sheets

54
29
12
15
11
13
28
27
30
32
16
14
21
23
10
18
20
51
39

50

BAG FOR STORING A FIRST SUBSTANCE INJECTABLE, IN PARTICULAR, IN A HUMAN OR ANIMAL BODY

BACKGROUND OF THE INVENTION

1. Field of the Invention

The present invention relates to a bag arrangement including a bag for accommodating a first substance to be inserted, in particular, into the human or animal body and having at least one jacket enclosed on all sides and a piercing device attached to the jacket or to be attached to it, with the piercing device having means for piercing the jacket.

2. Description of the Prior Art

SUMMARY OF THE INVENTION

This and other objects of the present invention, which will become apparent hereinafter, are achieved by providing a bag arrangement of the above describe type in which the a receptacle for accommodating a second substance is formed by the abutment of the piercing device, which is separated from the inner chamber of the bag with the first substance, with the mixing process being started between the first and second substances with or after the piercing device has been actuated.

A central idea of the present invention can be seen therein that a receptacle provided on the piercing device is made for accommodating a second substance which is separated vis-à-vis the bag interior or the first substance. The bag is made in such a way that, after the piercing device has been activated, a mixing process is initiated between the first and second substance.

The second substance can be present especially in a liquid, solid, powdery gaseous or gelatinous state. It should be especially noted that the first and second substance can, in principle, be the same, so that they can be refilled via the abutment by connection to a filling system or additional bag in the bag actually provided for draining. If a second bag is connected via the abutment and if the first and second substance are present in a liquid state with comparable viscosity, then, surprisingly, a mixing ratio of 50/50 results between the first and second substance in the bag actually tested. Second substances which can only be preserved for a short time in the first substance or which decompose relatively quickly in the first substance can be conveyed via the abutment to the first substance per bag puncture. Examples of secondary substances of this type are live microbiological cultures of sensitive substances such as glutamine or enzymes.

A further idea of the invention can be seen in the separating film inserted between the first and second substance, said separating film being perforated at the same time as the bag is punctured.

In another advantageous embodiment, the separating film is formed by the jacket of the bag itself, so that the manufacture and mounting of a separate separating film can be omitted.

In an actual preferred embodiment, the piercing device comprises a slide-mounted punch for puncturing the at least one jacket as well as an abutment into which the punch sinks when piercing the jacket.

Preferably, the receptacle for the second substance is formed by the abutment of the piercing device. Since the abutment is advantageous for mechanical reasons, the second substance to be inserted can be simultaneously accommodated therein. Actuating the piercing device and especially the sinking of the punch of the piercing. device accelerate the mixing process between the first and second substance.

In an alternative design, a draining connection is formed on the piercing device or a drain line can be attached thereto, whereby the receptacle is formed on the draining connection or in the drain line. In this embodiment, the mixing process takes place when the bag is being emptied whereas, in the alternatives described above, a first and second substance can also be mixed inside the bag prior to draining said bag.

In a possible embodiment, the abutment is only open toward the inside of the bag, however, it is covered with the separating film and otherwise sealed on all sides. In this embodiment, the second substance can already be inserted when manufacturing and assembling the bag or when attaching the piercing device to the jacket of the bag. This alternative design is suitable for second substances which can be preserved by themselves without contact with the first substance, whereby a mixing between first and second substance is desired prior to use of the bag.

Preferably, the receptacle is designed to accommodate a single pack containing the active substance provided with a perforable film. An especially cup-shaped abutment can, for example, form the receptacle for a tablet sealed with a film. When the perforable film is punctured, the first substance present in the bag can come into contact with the tablet, so that a desired effect is produced by mixing the first subtance and the second substance (here the tablet), or the second substance is dissolved.

Just when the first substance is present in liquid form, the piercing device can be provided with means that promote the flow of the liquid substance into the receptacle. This can, in particular, be attained thereby that the piercing device has a punch with cutting ribs, whereby the cutting ribs convey the liquid into the receptacle.

Alternatively to the design of the receptacle open to the bag interior, the receptacle can also have a further opening, preferably at its end facing away from the bag. This opening can be sealed by a protective cover or a protective film. When the protective cover is removed or the protective film perforated, a second or supplementary bag or a substance cartridge can be attached or the liquid drawn off. This design offers numerous additional application possibilities for the bag.

First, the connection of supplementary bags or bag systems or refilling devices will be considered. In this case, for example, the first substance in the bag to be drained could be diluted separately depending on the application. As already discussed above, a very constant mixing ratio of 50/50 results surprisingly in the configuration tested. This could be verified both via density measurements and via chloride ion determinations so as to be reproducible. To this end, 500 ml of a first substance in the bag were mixed with an additional 500 ml diluent as a second substance in the intermediate bag space.

In particular when administering nutrients from the bag, a complete diet can be put together with different substances by connecting supplementary bags, whereby these substances can be administered either simultaneously, staggered in time or in succession, without it being necessary to make any changes in the feeding devices between the first bag and the patient.

In an especially preferred embodiment, a substance cartridge can be attached to the receptacle. In this case also, we can keep the administration of nutrients in mind, whereby special active substances, additives, medicine or the like can be contained in the substance cartridge. With a bag of the proposed design, it is possible to add a suitable substance cartridge, or one prescribed by the doctor, to a first substance as basic substance depending on the individual patient's specific requirements. With respect to the possible designs for the substance cartridge which is attachable to the bag so as to be largely germ-free, reference is made to the actual embodiments described below.

Advantageously, for a largely germ-free attachment, the opening of the receptacle provided for the protective cartridge is covered with a protective film, whereby this protective film is cut through when the substance cartridge is inserted.

In an actual design, the substance cartridge can be either pushed onto the receptable or into the receptacle, whereby a seal between the substance cartridge and receptacle is ensured by at least one circumferential projection between substance cartridge and receptacle. The volume of the substance cartridge can be adapted to the volume of the receptacle. To increase the fill volume of the substance cartridge, however, an expansion outward is provided. In an actual design, this expansion is obtained at maximum in the form of a second bag that can be directly attached.

When both the substance cartridge and the receptacle have a circumferential projection, then they can first pass one another when they have a corresponding structural design when the substance cartridge is being slipped on or in, so that a mechanical interlocking results. The circumferential projections or protective cartridge and receptacle themselves are each made flexible in such a way that, in spite of this interlocking possibility, a sufficient seal is assured between substance cartridge and abutment. In an alternative design, a draining connection can also be formed on the receptacle on the side facing away from the bag. A substance can then be supplied or removed directly from the bag via the receptacle. This idea is claimed independent of the idea for inserting a second substance or mixing a first and second substance.

In a further special design, the piercing device, in particular, the operating piston of the piercing device also has a connection for attaching a connecting or drain line. For this purpose, a liquid outlet is provided between the operating piston and punch, so that a substance can be inserted into the bag or removed from the bag via the punch. This ides is also claimed independent of inserting a second substance and independent of the design of a draining connection on the receptacle. When connections are provided both on the operating piston and on the receptacle, an inlet and outlet can be simultaneously provided for a bag in a simple manner.

BRIEF DESCRIPTION OF THE DRAWINGS

The invention shall be described in greater detail in the following, also with respect to further features and advantages, with reference to the description of examples of embodiments and with reference to the attached drawings, showing.

DETAILED DESCRIPTION OF THE PREFERRED EMBODIMENTS

Figure 1A:
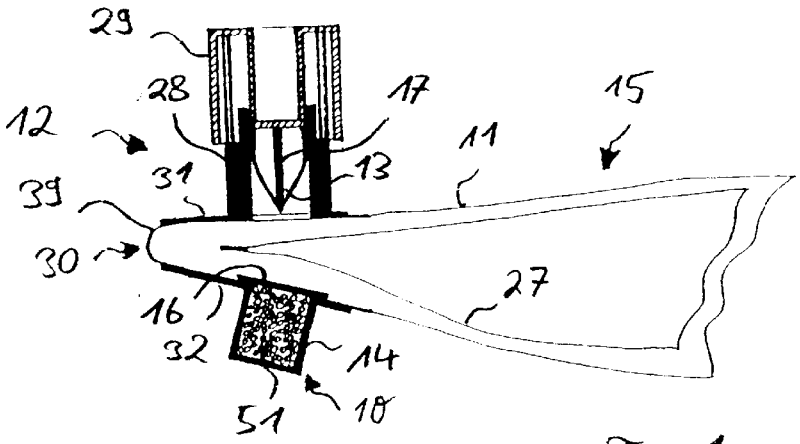
FIGS. 1*a* to 1*d* a first embodiment of a bag according to the invention having a second substance located in the abutment, whereby the piercing device is shown in the initial position (FIG. 1*a*), immediately prior to perforation of the jacket (FIG. 1*b*), after perforation of jacket and separating film (FIG. 1*c*) and after activating the piercing device and starting a mixing process between a first and second substance (FIG. 1*d*), FIG. 2*a* an embodiment of a plate bar with piercing device in the open state in a top view, FIG. 2*b* the plate bar with piercing device of FIG. 2*a* along the line IIb, IIb, FIG. 3*a* a partial sectional view of the piercing device, FIG. 3*b* the piercing device along the line IIIb, IIIb in FIG. 3*a,*

A first embodiment of the bag arrangement with a second substance 51 situated in a receptacle 10 is shown in FIGS. 1*a* to 1*d*. FIGS. 1*a* to 1*d* show the piercing device 12 in various positions, to illustrate its mode of operation. In this concrete embodiment, the piercing device 12 is welded onto the outer jacket 11 of a bag 15. A further inner jacket 27, sealed on all sides and in which a first substance 50 is packed so as to be germ-free, is found in the bag 15 shown here.

The piercing device 12 comprises a plate bar 30 on which a front plate 31 and a rear plate 32 are formed. The plate bar 30 forms a film hinge 39 between the front plate 31 and the rear plate 32. The front plate 31 of the plate bar 30 is welded to a first side of the jacket 11 and the rear plate 32 to an opposite side of the jacket 11 of the bag 15. The front plate 31 and rear plate 32 of the plate bar can come approach one another by means of the film hinge 39 by pressing the allocated bag corner or bag edge together.

In the area of the front plate 31, a punch 13 of the piercing device 12 is slide-mounted essentially at right angles to the plane of the front plate 31 in a cylindrical guide 28. An operating piston 29 for actuating the punch 13 is found at the end on the punch 13. Operating piston 29 or punch 13 are mounted so as to seal against the cylindrical guide 28, so that both the escape of a substance from the bag 15 and the entry of germs into the bag 15 is prevented.

In the area of the rear plate 32 of the plate bar 30, an abutment 14 is formed into which the punch 13 can enter when the piercing device 12 is actuated. The abutment 14 forms the receptacle 10. At the same time, according to the invention, the second substance 51 is accommodated in the abutment 14, said second substance 51 being insulated with a separating film 16 vis-à-vis the bag 15 interior.

When the piercing device 12 is actuated, the front plate 31 and rear plate 32 of the plate bar 30 are first pressed together, for example, thereby that operating piston 29 and abutment 14 are gripped between the thumb and index finger.

Figure 1B:
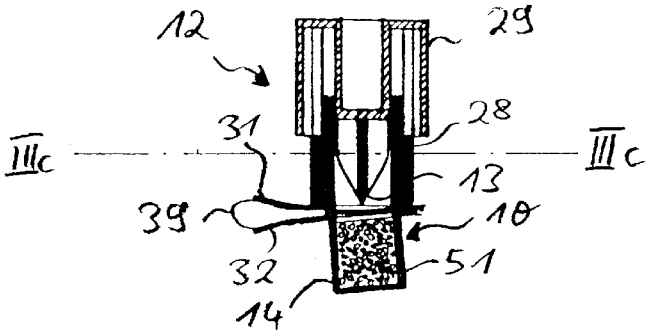
Figure 1C:
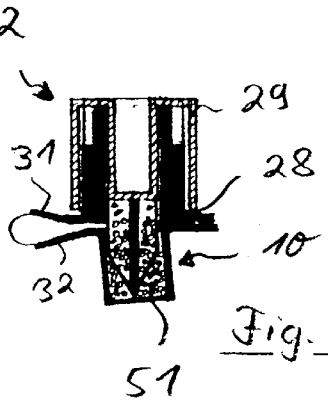
Figure 1D:
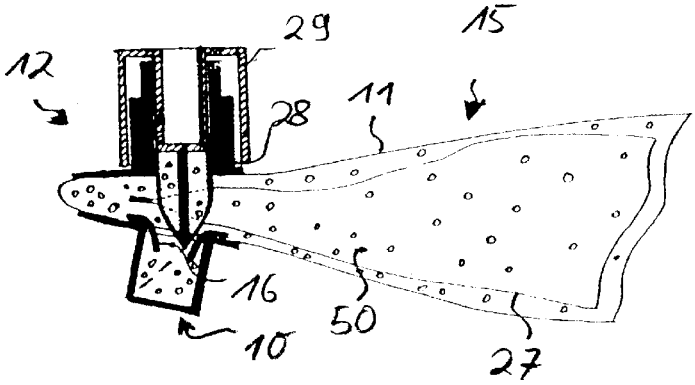

As can be seen in FIG. 1*b*, the abutment 14 is placed directly opposite the punch 13. If further pressure is now exerted on abutment 14 and operating piston 29, then punch 13 punctures the front side of jacket 11, twice through the inner jacket 27 and again on the rear through jacket 11 and perforates them. Alternatively, corresponding recesses can be provided on the front and/or rear in the outer jacket 11, so that a perforation of the outer jacket 11 is unnecessary. After perforation of the jacket(s) of the bag 15, according to the invention, the punch 13 also passes through a separating film 16 which covers the abutment 14 and insulates a second substance 51 from the interior of the bag 15. After this perforation (FIG. 1*d*), the second substance 51 can mix with the first substance 50 packed in the bag. In the embodiment shown, the first subtance 50 also does not reach into the area between inner jacket 27 and outer jacket 11 of bag 15 until the inner jacket 27 is perforated.

If a liquid substance is used as first substance 50, then there is a further advantage of the double bag actually shown.

When the bag 15 is suspending properly, the liquid first substance 50 flows out of the inner bag restricted by inner jacket 27 into the area between inner jacket 27 and outer jacket 11. This flowing out takes place, in part, via the area of the punch 13 of the piercing device. The punch 13 has cutting ribs 17 arranged crosswise, extending essentially parallel to the direction of piercing. The cutting ribs 17 convey the liquid first substance 50 into the area of the abutment 14, so that a second substance 51 found there is rinsed out properly after perforation of the separating film 16 and mixes surprisingly homogeneously with the first substance 50. The aforementioned "rinsing out" is extremely helpful when the second substance 51 is powdery or in form of a tablet.

Figure 2A:
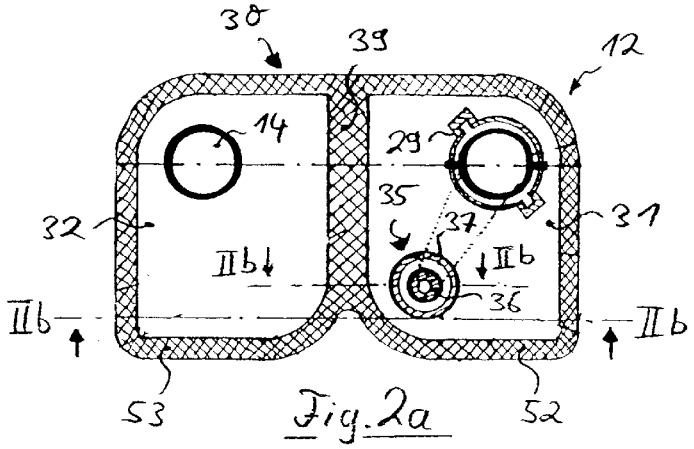
Figure 2B:
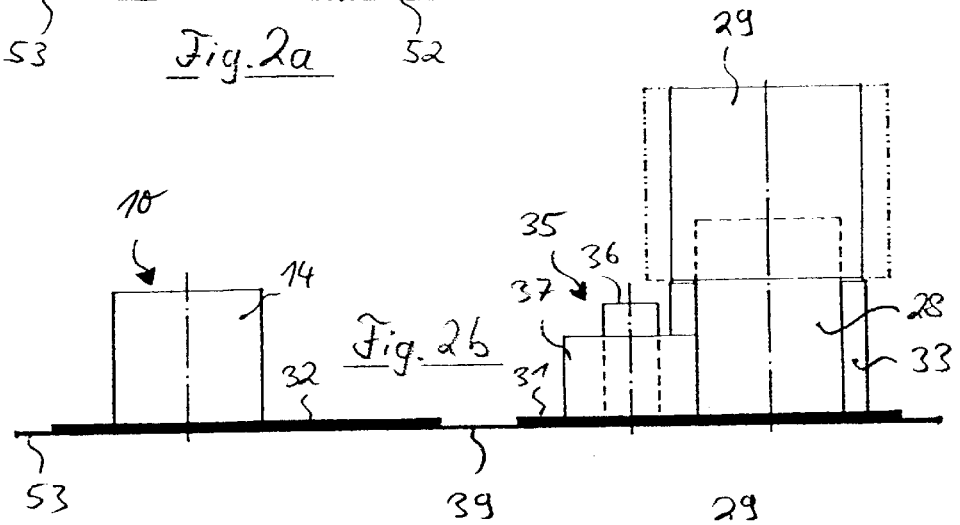

With reference to FIGS. 2*a* and 2*b*, the piercing device 12 will be described in greater detail in the following. In FIG. 2*a*, the plate bar 30 is shown in the open state. The abutment 14, made as one piece with the plate bar 30, is arranged on the rear plate 32. On the opposite side, the cylindrical guide 28 is also made in one piece with the plate bar 30 at a corresponding location on the front plate 31. The cylindrical guide 28 has two guide ribs 33 that correspond with corresponding grooves 34 in the operating piston 29.

Furthermore, on the front plate 31, a draining connection 35 is formed which has an outer connecting piece 37 and, concentrically thereto, an inner connecting piece 56. The inner connecting piece 36 is provided as a pipe socket for conveying out the first and second substance 50, 51 packed in the bag. The outer connecting piece 37 has an internal thread 38, so that a drain line 46 can be preferably connected via a Luer connection. The film hinge 39, already mentioned, is formed between the front plate 31 and rear plate 32 on the plate bar 30, said film hinge 39 being substantially thinner than the front and rear plate 31, 32. Front plate 31 and rear plate 32 are, furthermore, surrounded by film edges 52, 53. The plate bar 30 can be welded to. the outer jacket 11 of bag 15 via the film edges 52, 53.

The piercing device IIb, IIb in FIG. 2*a* is shown in FIG. 2*b*. Essentially true to scale are the various thicknesses between the front plate 31 and rear plate 32, on the one hand, and the film hinge 39, on the other hand. It should be pointed out that the guide ribs 33, do not extend over the entire length of the cylindrical guide 28, so that the operating piston 29 can be turned relative to the cylindrical guide 28 in its initial and rest position. Only when the grooves 34 provided in the operating piston correspond to the guide ribs 33, the operating piston 29 and with it the punch 13 can be pressed in, so that an unintentional perforation of the bag is made more difficult. It should also be noted that an interlocking is effective between cylindrical guide 28 and operating piston 29, such that the operating piston 29 is ensured against falling off from the cylindrical guide 28.

Figure 3B:
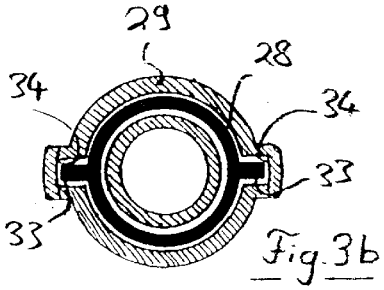
FIG. 3*c* a sectional view of the piercing device along the line IIIc IIIc in FIG. 1*b,*
FIG. 3*d* the draining connection along the line IIId, IIId in FIG. 2*a,*
Figure 3C:
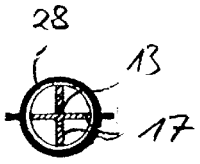
Figure 3A:
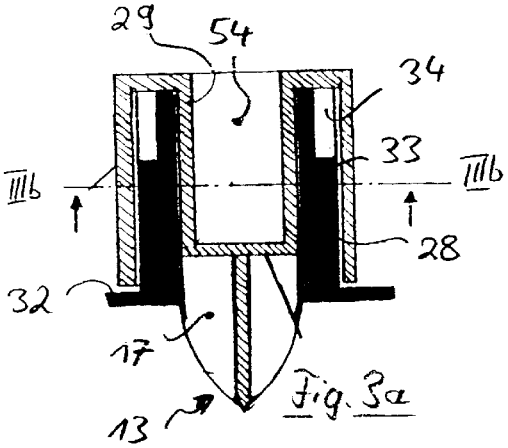

In FIG. 3*a*, the actual arrangement between the cylindrical guide 28 and the operating piston 29 as well as the punch 13 is shown in a sectional view. The operating piston 29 has a central middle recess 54 that enters into the cylindrical guide 28 and slides along the cylindrical guide 28 on the inside. Between the recess 54 of the operating piston 29 and the cylindrical guide 28, a surround seal is effective which prevents a substance from escaping from the bag 15 or germs or contaminants from entering the bag 15. The punch 13 is arranged inside the operating piston 29 below recess 54, said punch 13 having two cuttings ribs 17 extending crosswise to one another.

A sectional view of the cylindrical guide 28 and the operating piston 29 along the line IIIb, IIIb in FIG. 3*a* is shown in FIG. 3*b*. In the position shown, the guide ribs 33 of the cylindrical guide 28 correspond with the grooves 54 of the operating piston 29, so that the punch 13 can be shifted in the piercing device.

In FIG. 3*c*, a sectional view of the punch 13 mounted so as to be slidable in the cylindrical guide 28 is shown. The alignment of the operating piston 29 and thus the punch 13 with its cutting ribs 17 can be determined by the guide ribs 33 provided on the cylindrical guide 28, so that conditions can be created that are always reproducible for the perforation of the jacket(s) as well as the separating film 16 and for the inlet of the first substance 50.

Figure 3D:
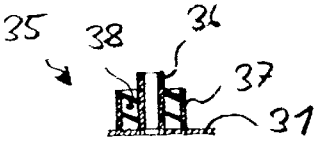

The draining connection 35 from FIG. 2*a* is shown in FIG. 3*d* in a sectional view along the line IIId, IIId. The internal thread 38 in the outer connecting piece 37 can be clearly seen. The inner connection piece 36 is longer than the outer connecting piece 37 and protrudes on the end facing away from the front plate 31.

Figure 4A:
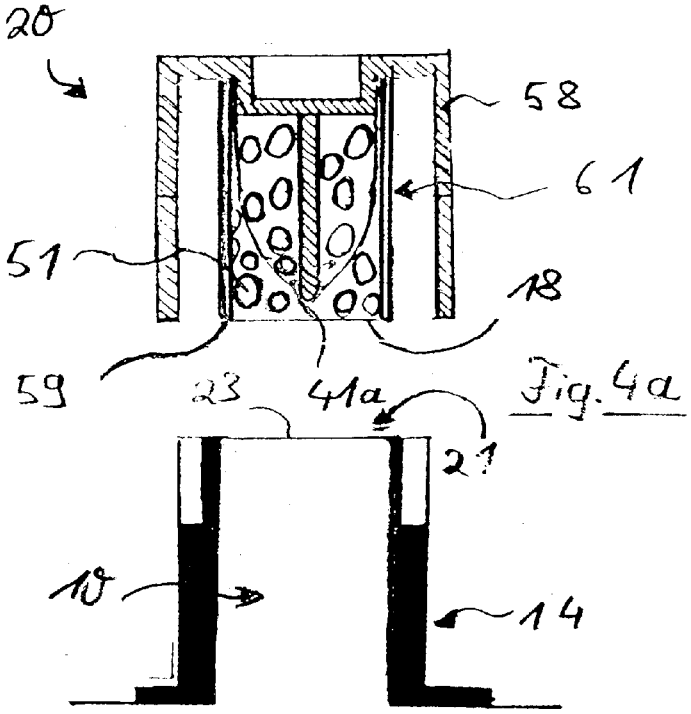
FIG. 4*a* an embodiment of a substance cartridge that can be mounted on an abutment prior to assembly, FIG. 4*b* the substance cartridge slipped onto the abutment from FIG. 4*a;*
Figure 4B:
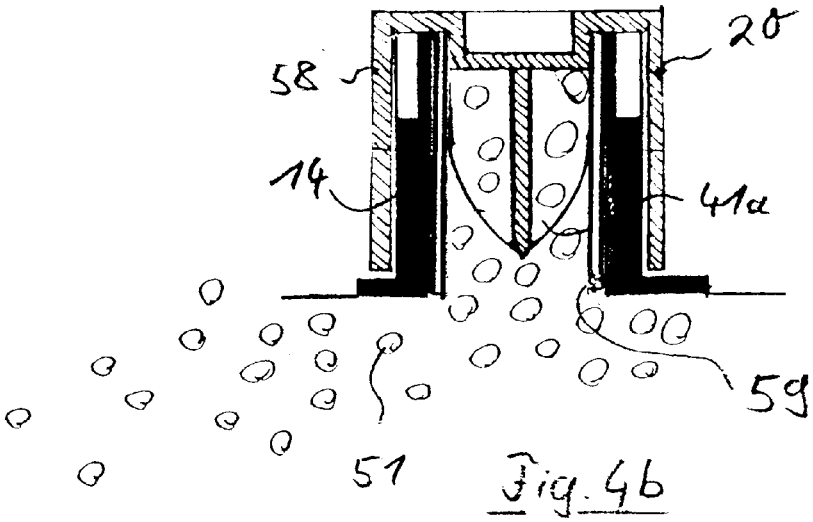

In FIGS. 4*a* and 4*b*, an embodiment of a substance cartridge 20 that is mountable on the abutment 14 is shown. In this embodiment, the abutment 14 has an opening 21 on its end facing away from the bag 15. The opening 21 can be sealed with a protective cover. The protective cover can, for example, be made like a removable cover, preferably, however, a protective film 23 is provided which seals the opening 21 so as to be germ-free.

The substance cartridge 20 according to this embodiment comprises an inner chamber 61 in which the second substance 51 is housed. On the outside, the substance cartridge 20 is limited by a hat-shaped cap 58 inside which the chamber 61 is located. The chamber 61 is limited by a wall 59, a part of the inner side of the hat-shaped cap 58 as well as by a protective film 18. The protective film 18 houses the second substance 51 and protects against contaminations and germs. When the protective cartridge 20 is placed on the abutment 14, this protective film 18 is also cut through.

To perforate the protective film 18 of the substance cartridge 20 and the protective film 13 of the abutment 14, a punch 41 a is centrally arranged inside the chamber 61 of the substance cartridge 20, the tip of said punch 41 being slightly spaced from the protective film 18 of the substance cartridge 20. As soon as the substance cartridge 20 is placed on the abutment 14, the protective film 18 is thereby lightly pressed inward and finally on the punch 41 a, so that the protective film 18 is cut through. At the same time, the now exposed punch 41 a acts on the protective film 23 of the abutment 14 and also cuts through it, so that the chamber 61 already inserted into the abutment 14 enables a germ-free passage of the second substance 51 into the abutment 14.

The chamber 61 has an outer cross section corresponding to the inner cross section of the abutment 14 which is, however, dimensioned slightly smaller, so that the chamber 61 can be pushed into the abutment 14. Chamber 61 and abutment 14 can have an essentially circular cross section, an oval, rectangular cross section or a cross section of another shape.

The inner cross section of the hat-shaped cap 58 can also be adapted to the outer cross section of the abutment in an appropriate manner.

Seals are preferably provided between the inner wall of the abutment 14 and the chamber 61. The seals are advantageously arranged in such a way that they pass one another when being mounted and thus ensure a locking of the chamber 61 or the substance cartridge 20 on the abutment 14. Alternatively, seals can also be provided between the outer side of the abutment 14 and the inner side of the hat-shaped cap 58, whereby a locking of the substance cartridge 20 on the abutment 14 can also be simultaneously obtained when the seals are designed appropriately.

In FIGS. 5*a* to 5*e*, a third alternative embodiment of a substance cartridge 20 is shown for coupling to the abutment 14. Contrary to what is shown in FIGS. 4*a* and 4*b*, the substance cartridge 20 is here made for insertion into the abutment 14.

Figures 5A, 5B, 5C, 5D, 5E:
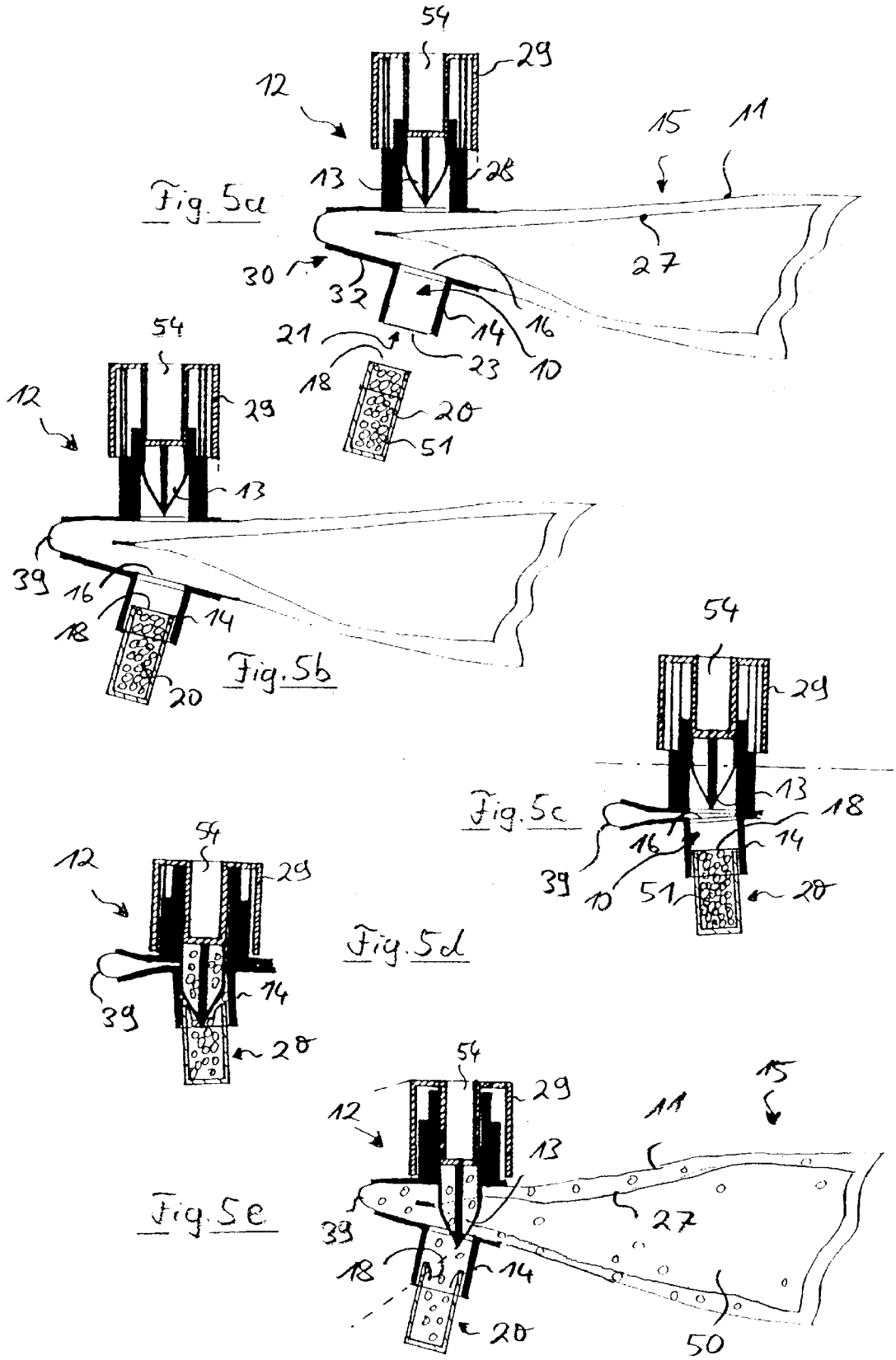
FIG. 5*a* an embodiment of a substance cartridge that can be inserted into the abutment prior to being inserted, FIG. 5*b* the substance cartridge inserted into the abutment, FIG. 5*c* the bag according to FIG. 5*a* with inserted substance cartridge when actuating the piercing device prior to perforation of the jacket, FIG. 5*d* the bag of FIG. 5*a* when actuating the piercing device after perforation of the jacket as well as after perforation of the separating film between a first and second substance, FIG. 5*e* the bag of FIG. 5*a* with piercing device and substance cartridge inserted into the abutment after mixing first and second substance, FIG. 6 an embodiment for an intermediate piece which can be inserted between a drain line and the abutment and with a second substance, FIG. 7 an embodiment in which a number of supplementary bags are coupled to the abutment of a first bag, FIG. 8*a* an alternative embodiment of a plate bar with piercing device, in a sectional view, FIG. 8*b* the plate bar with piercing device from FIG. 8*a*, in a top view, FIG. 8*c* a partial sectional view of a piercing device for use on a plate bar according to FIG. 8*a* and FIG. 8*b*.

As can be seen in FIG. 5*a*, the abutment 14 is open at its two ends and thereby covered with a separating film 16 toward the bag interior and with a protective film 23 to the end facing away from the bag 15.

The substance cartridge 20 has an outer cross section corresponding to the inner cross section of the abutment 14. The substance cartridge 20 can have a circular, oval, rectangular cross section or a cross section of another shape. The substance cartridge 20 itself is covered with a protective film 18 on its front side in direction of insertion.

As can be seen in FIG. 5*b*, the protective film 23 of the abutment 14 perforated when the substance cartridge is pushed in. In this embodiment also, the substance cartridge 20 as well as abutment 14 has circumferential seals at each of the surfaces facing one another, said seals preventing the substance from escaping bag 15 or from escaping from the substance cartridge 20 or germs from entering the abutment 14. The seals are, moreover, advantageously made in such a way that they pass one another when being inserted and thus ensure that the substance cartridge 20 is locked in the abutment 14.

FIGS. 5*c*, 5*d* and 5*e* illustrate the actuating of the piercing device 12 when a substance cartridge 20 has been inserted. The punch 13 of the piercing device 12 can, in this embodiment, also cut through the separating film 16 on the abutment 14 as well as the protective film 18 of the substance cartridge in addition to the perforation of jackets 11 and 27, so that the second substance 51 found in the substance cartridge 20 can reach inside the bag 15 and mix there with the first substance 50.

Figure 6:
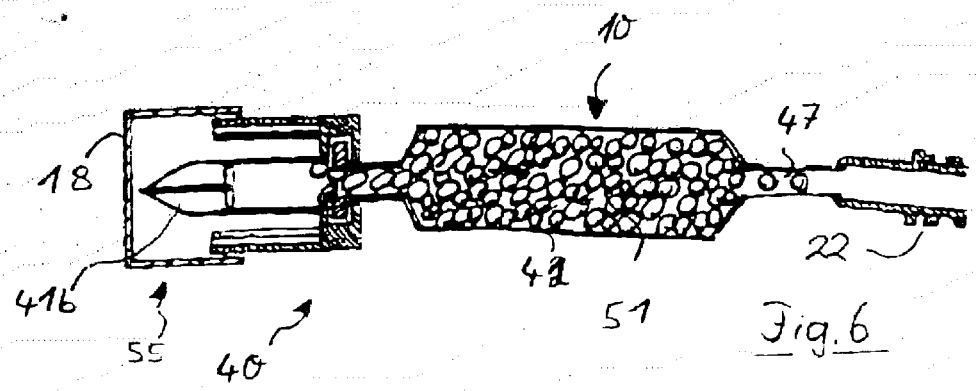

In FIG. 6, an intermediate piece 40 is shown in a diagrammatic sketch. The intermediate piece 40 can be connected to the abutment 14 for draining or filling the bag 15. For this purpose, the intermediate piece 40 has on its end provided for connection to the abutment 14 an adapter 55 which can be mounted on the abutment 14 in a manner similar to the one shown in FIGS. 4*a* and 4*b* for the substance cartridge 20. Prior to use, the adapter 55 is covered with a protective film 18 on its end. Inside the adapter 55 and covered by the protective film 18, there is a punch 41*b* that cuts through both the protective film 18 of the adapter and the protective film 23 of the abutment 14 when pressing the adapter 55 onto the abutment 14.

At its opposite end, a further connection 22 can be provided on the intermediate piece 40, said connection 22 being made in a manner corresponding to the draining connection 35 shown in FIG. 3*d*. Between the adapter 55 as the one end of the intermediate piece and a connection on the other end extends a connecting line 47 which can be made as a straight connecting line having a uniform cross section. In the present case, however, an expansion 42 is provided in the connecting line 47 as receptacle 10 for the second substance in which a predetermined volume of a second substance 51 is housed. The bag 15 can be drained with an intermediate piece of this type provided with a second substance 51 and the second substance 51 thereby rinsed out directly by means of the first substance 50 of the bag 15 when it flows through.

Figure 7:
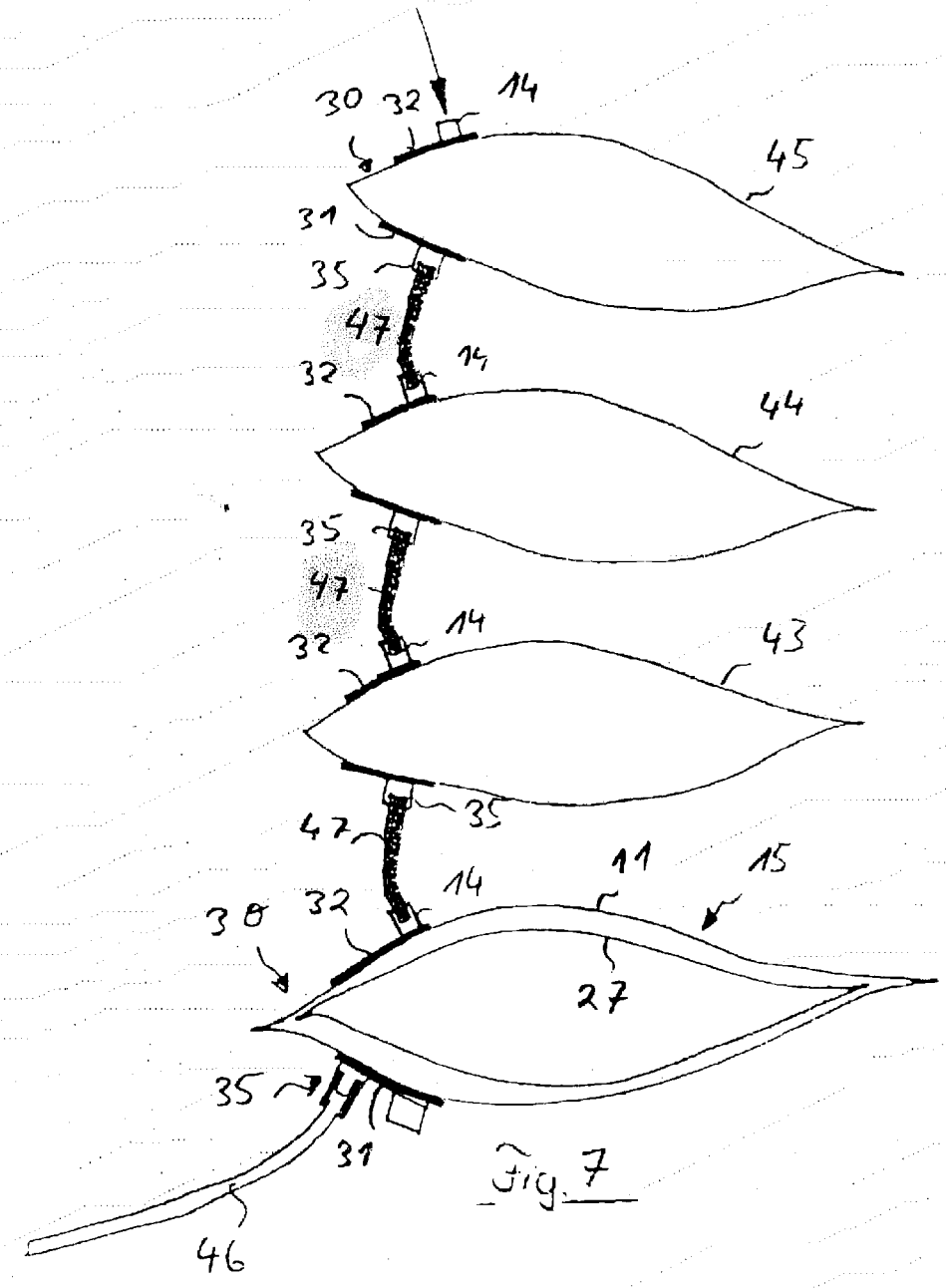

An embodiment is shown in FIG. 7 in which a number of supplementary bags 43, 44, 45 are connected in series to the abutment 14 of the bag 15. For example, via the intermediate piece 40 described with reference to FIG. 6 in which the expansion 52 provided for accommodating the second substance 51 does not have to be provided, a supplementary bag 43 having its draining connection 35 on the abutment 14 of the bag 15 can be attached. As a result, almost any number of bags 15 desired can be coupled together, so that a drain line 46 leading e.g. to the patient can be permanently left between the patient and the bag 15. The supplementary bags 43, 44, 45 can be provided as a "refill pack" for bag 15. A diluting of the first substance 50 in bag 15 can also be obtained with an supplementary bag 43.

Furthermore, by connecting one or more supplementary bags 43, 44, 45, a complete diet can be put together for a patient, whereby the supplementary bags 43, 44, 45 can be drained simultaneously, staggered in time or in succession. The arrangement shown in FIG. 7 is purely schematical and is to illustrate the connection in series of several bags, whereby the number of bags can be arranged horizontally to one another, vertically or in any other position desired.

Figure 8A:
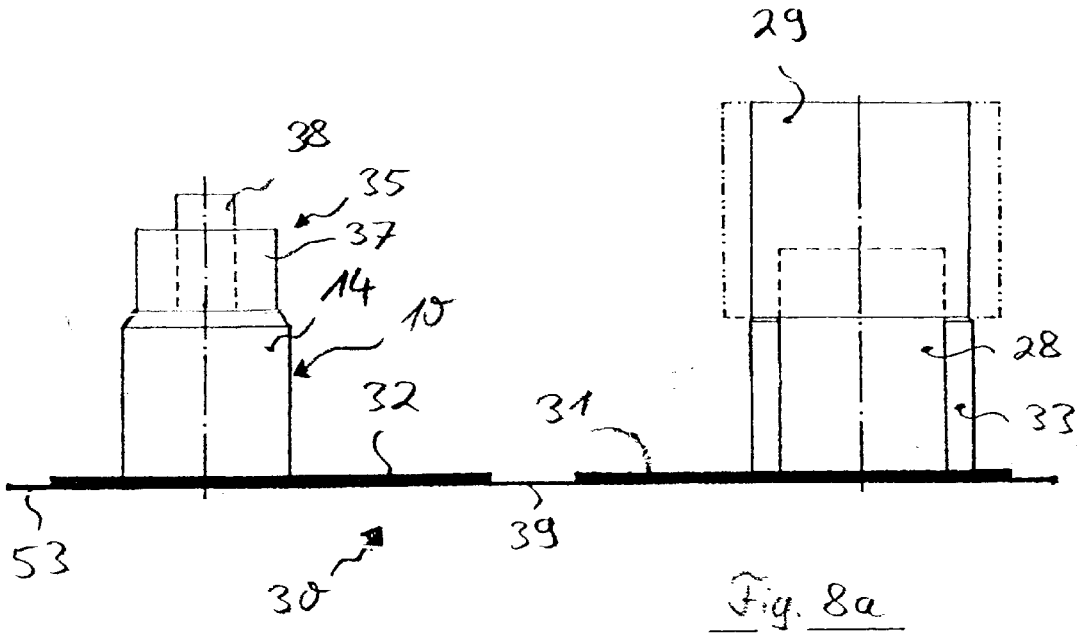
Figure 8B:
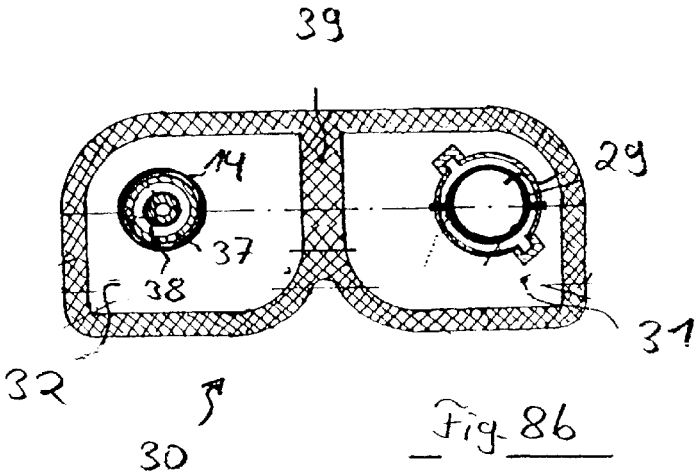

An alternative embodiment of a plate bar with a piercing device 12 is shown in FIGS. 8*a* and 8*b*. In the embodiment shown in FIGS. 8*a* and 8*b*, the draining connection 35 is formed directly on the side facing away from the plate bar 30 to the abutment 14. As a result, substance can be supplied to the bag 15 or removed from it via the abutment.

In FIG. 8*b*, the plate bar 30 is shown in a top view according to this modified embodiment. The plate bar according to this embodiment can be made smaller than in the embodiment according to FIG. 2*a*, since the draining connection 35 does not have to be arranged separately but is formed on the abutment 14.

If the draining connection 35 is in fact used for emptying and not for filling the bag 15, which is also possible in principle, the drain level in this embodiment is found at the level of the piercing device 13, so that, under certain circumstances, no complete emptying is possible. However, the plate bar 30 having a piercing device 12, abutment 14 and draining connection 35 can be substantially more simple.

Figure 8C:
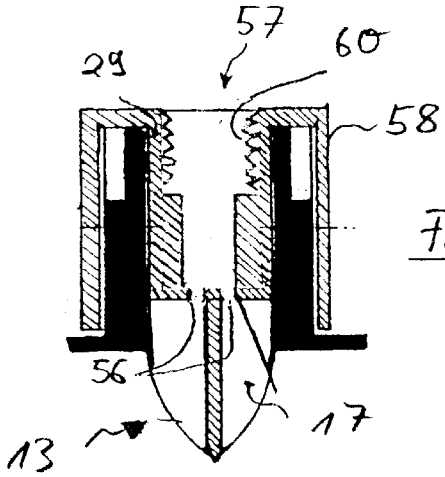

In FIG. 8*c*, a partial sectional view of the piercing device 13 is shown which is modified vis-à-vis the embodiment shown in FIG. 3*a*. Different than with the operating piston 29 of the embodiment according to FIG. 3*a*, a flow outlet 56 is made between the operating piston 29 and the punch 13, so that, once the bag 15 has been pierced by means of punch 13, substance can reach from the bag 15 into the interior of the operating piston 29 or in the operating piston 29 into bag 15. In order to be able to connect a connection line 47, 48, 49 or a drain line 46, an internal thread 60 is worked into the recess 54 of operating piston 29. The recess 54 defines together with the internal thread 69 in this embodiment a connection 57 for the connection of supplementary bags 43, 44, 45 via connecting lines 47, 48, 49 or for connecting a drain line 46.

For example, the supplementary bags 43, 44, 45 shown in FIG. 7 can be provided with a plate bar 30 and piercing device 12 according to FIGS. 8*a*, 8*b* and 8*c*. The bag 15 having an outer jacket 11 and an inner jacket 27 is, on the other hand, equipped with a plate bar 30 as per FIGS. 2*a* and 2*b*. The idea, to make the abutment 14 with a draining connection 35 and/or providing a flow outlet 56 in the operating piston 29 is claimed as essential to the invention independent from inserting a second substance.

The bag system shown in FIG. 7 is distinguished by a high-quality bag 15 that enables a visual control possibility when a transparent jacket 11 is provided and by supplementary bags 43, 44, 45. The supplementary bags 43, 44, 45 enable numerous additional application possibilities (mixing, staggered in time, supply of substance completely spaced in time, etc.) and are, moreover, structured substantially more simply, both with respect to the bags 43, 44, 45 and the plate bar 30.

| List of Reference Numbers | |
|---|---|
| 10 | Receptacle |
| 11 | Jacket (outer) |
| 12 | Piercing device |
| 13 | Punch (piercing device) |
| 14 | Abutment |
| 15 | Bag |
| 16 | Separating film |
| 17 | Cutting ribs |

-continued

| List of Reference Numbers | |
|---|---|
| 18 | Protective film (substance cartridge) |
| 20 | Substance cartridge |
| 21 | Opening |
| 22 | Connection |
| 23 | Protective film (abutment) |
| 27 | Jacket |
| 28 | Cylindrical guide |
| 29 | Operating piston |
| 30 | Plate bar |
| 31 | Front plate |
| 32 | Rear plate |
| 33 | Guide ribs |
| 34 | Groove |
| 35 | Draining connection |
| 36 | Connecting piece (inner) |
| 37 | Connecting piece (outer) |
| 38 | Internal thread |
| 39 | Film hinge |
| 40 | Intermediate piece |
| 41a | Punch (substance cartridge) |
| 41b | Punch (intermediate piece) |
| 42 | Expansion |
| 43, 44, 45 | Supplementary bags |
| 46 | Drain line |
| 47, 48, 49 | Connecting lines |
| 50 | First substance |
| 51 | Second substance |
| 52, 53 | Film edges |
| 54 | Recess |
| 55 | Adapter |
| 56 | Flow outlet |
| 57 | Connection (operating piston) |
| 58 | Hat-shaped cap |
| 59 | Wall |
| 60 | Internal thread |
| 61 | Chamber |

What is claimed is:

1. A bag arrangement for intermixing two, separately stored substances, comprising a bag having a jacket defining an inner chamber for accommodating a first substance; and a piercing device having a chamber in which the jacket is received, a single piercing member provided on one side of the jacket, and a hollow abutment located opposite the piercing member on an opposite side of the jacket and forming a receptacle for accommodating a second substance, whereby upon actuation of the piercing device, the piercing member, piercing the opposite sides of the jacket, provides for intermixing of the first and second substances, wherein the piercing member has cutting ribs for cutting through the jacket.

2. A bag arrangement as set forth in claim 1, wherein the cutting ribs have a shape that provides for flow of a liquid, when the first substance is in liquid form, into the receptacle.

* * * * *